US005460298A

United States Patent [19]

DiBiase et al.

[11] Patent Number: 5,460,298

[45] Date of Patent: Oct. 24, 1995

[54] STAND FOR CONTAINER INVERSION

[76] Inventors: Anthony E. DiBiase, 1393 Dahlia St., Hartville, Ohio 44632; Robert M. Wise, 2890 Mogadore Rd., Apt. A19, Akron, Ohio 44312

[21] Appl. No.: 997,039

[22] Filed: Dec. 28, 1992

[51] Int. Cl.[6] ..... B67D 5/64

[52] U.S. Cl. ..... 222/173; 222/184

[58] Field of Search ..... 222/181, 185, 222/179.5, 173; 604/301, 302; 141/364–375

[56] References Cited

U.S. PATENT DOCUMENTS

| | | | |
|---|---|---|---|
| 382,218 | 5/1888 | Dehnert | 222/179.5 |
| 520,307 | 5/1894 | Gillham | 222/185 X |
| 939,594 | 11/1909 | Fulper | 222/185 X |
| 1,075,268 | 10/1913 | Oliphant | 222/185 X |
| 2,259,992 | 10/1941 | Binon | 222/179.5 |
| 3,172,575 | 3/1965 | Vosburg | 222/185 |
| 3,456,650 | 7/1969 | Schwartzman | 604/301 X |
| 3,754,690 | 8/1973 | Marchant | 222/173 X |
| 3,777,948 | 12/1973 | Hafele | 222/212 X |
| 3,945,381 | 3/1976 | Silver | 604/301 |
| 4,271,878 | 6/1981 | Bologa | 141/375 |
| 4,389,926 | 6/1983 | Joyner | 141/375 X |
| 4,733,802 | 3/1988 | Sheldon | 222/181 |
| 4,881,661 | 11/1989 | Jones | 222/185 X |
| 4,930,668 | 6/1990 | Krall | 222/185 X |
| 4,969,581 | 11/1990 | Seifert et al. | 222/185 X |
| 5,080,150 | 1/1992 | Deadwyler, Jr. | 141/364 |
| 5,104,003 | 4/1992 | Stecoza | 222/181 X |
| 5,105,860 | 4/1992 | Connor | 141/364 X |
| 5,118,012 | 6/1992 | Miller et al. | 222/179.5 X |
| 5,149,041 | 9/1992 | Hartke | 248/146 |
| 5,180,083 | 1/1993 | Carlson | 222/185 |
| 5,215,133 | 6/1993 | Cambert | 222/181 X |
| 5,263,787 | 11/1993 | Wilcox et al. | 222/179.5 X |
| 5,277,332 | 1/1994 | Rogers | 222/181 X |

FOREIGN PATENT DOCUMENTS

| | | | |
|---|---|---|---|
| 2634177 | 1/1990 | France | 222/185 |

*Primary Examiner*—Andres Kashnikow
*Assistant Examiner*—Kenneth DeRosa
*Attorney, Agent, or Firm*—Renner, Kenner, Greive, Bobak, Taylor & Weber

[57] ABSTRACT

A stand for container inversion is provided to allow for prompt, efficient, and full dispensing of viscous material from their containers. A cup-shaped stand is interposed between a bottle and its cap, the stand defining a support surface to allow the container to be maintained in an inverted posture. The stand may be an integral portion of the bottle or of the cap, or it may be a separate entity altogether. Additionally, the stand may be configured such as to nestingly receive the bottom of the container or bottle when implementation of the stand is not desired.

11 Claims, 2 Drawing Sheets

STAND FOR CONTAINER INVERSION

TECHNICAL FIELD

The invention herein resides in the art of containers and associated devices. The invention more particularly relates to a stand for containers of viscous materials which allow for the storage of such containers in an inverted posture to allow the contents to be retained near the container opening. More specifically, the invention relates to a stand for containers of condiments, shampoos, and like materials, allowing for the prompt, efficient, and full dispensing of the same.

BACKGROUND ART

Many liquid materials are sold in bottles or other rigid or semi-rigid containers which, depending upon the viscosity of the liquid, make full and complete dispensing of the contents a difficult proposition. Representative of such products are condiments, salad dressings, shampoo, and the like. Typically, the containers for such products are configured such that the opening through which the product is to be dispensed is at the top of the container, opposite the bottom of the container which is normally received upon a support surface, such as a refrigerator shelf, during storage. As the contents of the container diminish through use, the amount of time required for the contents to reach the mouth or opening of the container for ultimate dispensing increases. Indeed, there is typically an inverse relationship between the volume of the material in the container and the amount of time required to effectuate the dispensing of a desired quantity from the container.

The nature of viscous materials such as those described above, coupled with the configuration of presently known containers for such materials, give rise to frustration and waste in the dispensing operation. Frequently, an individual will simply discard the container with a substantial volume of the viscous material therein simply because complete dispensing of the contents of the container cannot be achieved in a reasonable period of time following the determination that a quantity of the material is desired.

In the prior art, U.S. Pat. Nos. 4,271,878, 5,080,150, and 5,105,860 present support devices of various types which are intended to receive a container in an inverted open condition to drain the contents of the container into a receptacle. The devices do not, however, teach the actual support of the container in an inverted position with the cap in place, to allow the contents of the container to drain toward the cap and to be stored in such a position. Of further general interest in the prior art is U.S. Pat. No. 5,149,041 which teaches the storage of a container in an inverted posture with its cap in place, but such a device is employed to improve the seal of the cap and to maintain carbonation of the contents, rather than to allow the contents of the container to move from the bottom of the container to the capped end of the container for dispensing.

The prior art appears to be devoid of any type of stand for a container of viscous material which allows the container to be stored in an inverted position to allow the viscous contents thereof to drain over time toward the capped end of the container so that prompt, efficient, and full dispensing of the contents can be attained.

DISCLOSURE OF INVENTION

In light of the foregoing, it is a first aspect of the invention to provide a stand for container inversion which allows for prompt, efficient, and complete dispensing of viscous materials from the container.

Another aspect of the invention is the provision of a stand for container inversion which is unobtrusive, and which may be left on the container during the dispensing operation.

Yet a further aspect of the invention is the provision of a stand for container inversion which may be received at the top of the container while serving as an inversion stand, or may be received on the bottom of the container when not required for such purpose.

An additional aspect of the invention is the provision of a stand for container inversion which may be an integral portion of the cap or container.

Still a further aspect of the invention is the provision of a stand for container inversion which may be customized to fit various containers.

Yet another aspect of the invention is the provision of a stand for container inversion which provides the same stability for the container when the container is stored inverted as when it is stored in its normal posture.

Another aspect of the invention is the provision of a stand for container inversion which is reliable and durable in use and operation, and which is easy to employ with state of the art techniques and apparatus.

The foregoing and other aspects of the invention which will become apparent as the detailed description proceeds are achieved by a device for receiving, storing, and dispensing viscous materials, comprising: a container; a cap at a first end of said container, said cap being selectably opened and closed to respectively accommodate dispensing and storage of contents of said container; and a stand engaging said container at said first end thereof and supporting said container in an inverted posture with said first end at a lowermost position when said cap is closed, said inverted posture allowing said contents of said container to move to said first end.

Other aspects of the invention which will become apparent herein are attained by a stand for receiving and maintaining a container, having a dispensing opening therein, in an inverted position with the dispensing opening at a bottom of the container and closed by a cap, comprising: a generally tubular member having a first open end and a second substantially closed end, said second end having an aperture for receiving an end of the container having the dispensing opening therein, said tubular member being adapted to be secured to the container by the cap.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
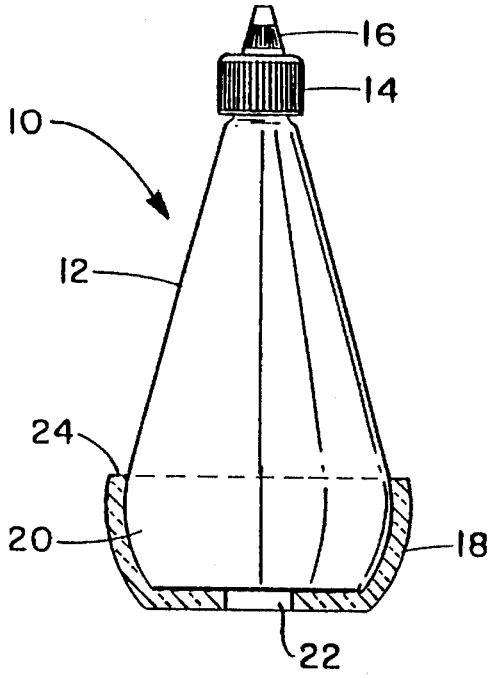
FIG. 1 is a front elevational view in partial cross section showing a container nested in the stand of the invention in a normal posture.

Referring now to the drawings and more particularly FIG. 1, it can be seen that a container assembly according to the invention is designated generally by the numeral 10. As a portion of the assembly 10, a bottle or other suitable container 12 receives or maintains a viscous material therein. Typically, the bottle 12 will be of plastic, glass, pressed fiber, or the like. In some embodiments, the bottle 12 will be of a rigid or semirigid construction, while in others, the bottle may be of the "squeeze" type. A cap 14 is typically threaded or snap fit onto the top of the bottle 12, covering the mouth thereof and providing a means for making selectable access to the contents of the bottle 12. In the embodiment shown, a nozzle 16 is provided as an integral portion of the cap 14 to allow the bottle 12 to be opened or closed for the respective dispensing or storage of the contents thereof. In the embodiment shown in FIG. 1, the nozzle 16 is of the telescopic twist cap type, such that rotation of the nozzle 16 will engage or disengage an aperture thereof with a plunger or seal to effectuate the opening and closing operations.

Also included as a portion of the container assembly 10 is a stand 18 which is of a cup-like nature, nestingly receiving the bottom portion 20 of the bottle 12. In the preferred embodiment of the invention, the stand 18 is molded of plastic or other suitable material and is configured such that the interior thereof is substantially congruent with the exterior of the bottom portion 20 of the bottle 12. While not necessarily required, it is preferred that the stand 18 be of a dear or transparent plastic such that the totality of the bottle 12 may be apparent. It is contemplated that the container assembly 10 will typically be as shown in FIG. 1 at the point of sale on a store shelf or the like and, accordingly, the clear nature of the stand 18 is desirable from that standpoint.

The bottom of the cup-shaped stand 18 is substantially closed, but for the presence of an aperture 22 passing therethrough. In the preferred embodiment, the aperture 22 is centrally located in the bottom of the stand 18, but it will be understood that the position thereof may vary. The aperture 22 is configured to be received over the mouth of the bottle 12 and to be retained thereon by the cap 14 as will become apparent with reference to FIGS. 2 and 3 herein. The aperture 22 will typically be circular in nature, but it will be understood that if the mouth of the bottle is of a different configuration, the aperture 22 may be designed to be matingly received thereby.

Figure 2:
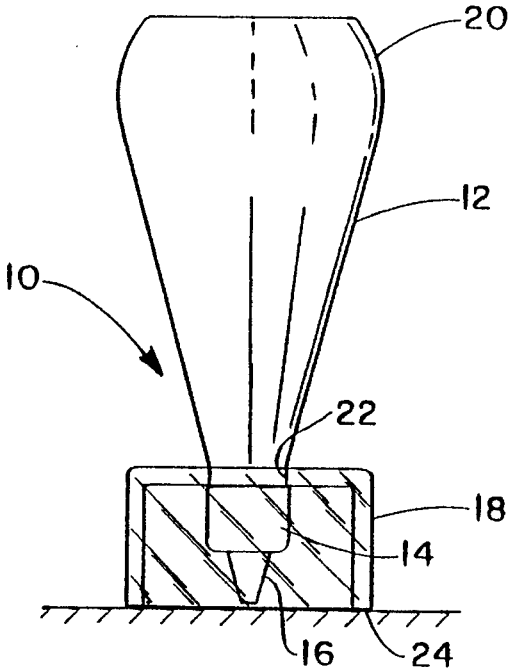
FIG. 2 is a front elevational view of a container received and maintained in an inverted position by the stand of the invention.

When the container assembly 10 has been purchased and is to be put into use, the stand 18 may be removed from the bottom portion 20 of the bottle 12 for its intended purpose. The cap 14 is removed from the mouth of the bottle 12 and the aperture 22 placed thereover. The cap 14 is then replaced as by threaded or snap fit engagement as is understood by those skilled in the art. The stand 18 is positioned on the bottle 12 such that the cap 14 and nozzle 16 are maintained within the cup-shaped stand 18. With the stand so positioned, the bottle 12 may be maintained in an inverted position during storage as best shown in FIG. 2.

It will be appreciated that the edge 24 of the stand 18 provides a support surface and, in that regard, the edge 24 typically defines a plane. The depth of the cup of the stand 18 is preferably such that the nozzle 16 is totally within the cup when in the closed position and extends beyond the cup when in the open position. In other words, the nozzle 16 is totally within the cup and does not break the plane of the edge 24 when closed, but extends beyond the cup and breaks such plane when open.

Figure 3:
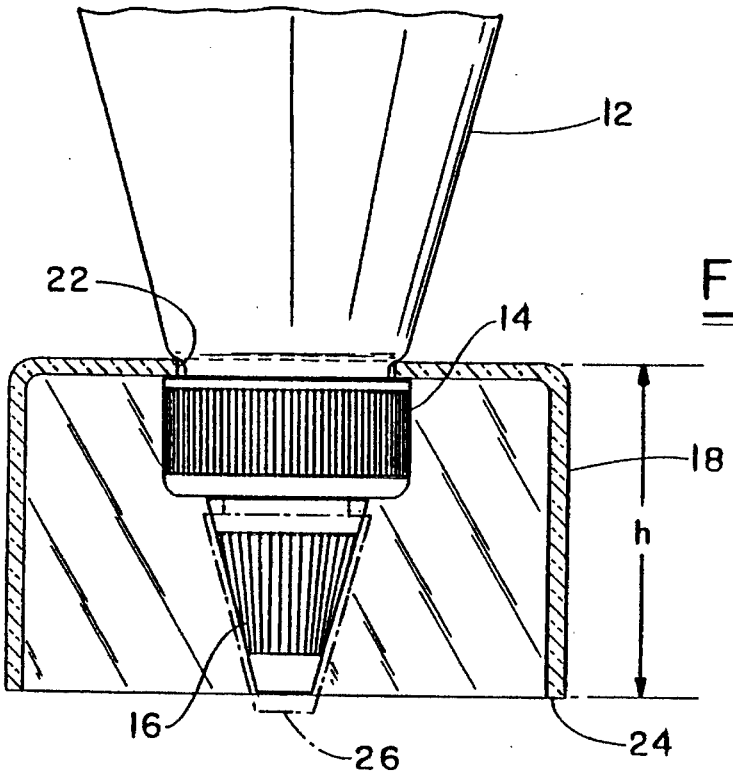
FIG. 3 is a partial sectional view of an inverted container received by the stand of the invention wherein a twist cap is employed.

With reference to FIG. 3, the purpose of configuring the depth of the stand 18 as described above can be appreciated. It will be desired to store the container 12 in the inverted position only when the nozzle 16 is closed. In that posture, the nozzle 16 does not interfere with the support plane defined by the edge 24. However, in the open position, as shown in phantom in FIG. 3, the end of the nozzle 26 extends beyond the plane and will cause the container 12 to rock or otherwise be unstable if an attempt is made to set it in the inverted posture when the nozzle 16 is open. This dimensioning precludes inadvertent spills or discharge.

It will further be appreciated that with the stand 18 being configured to nestingly receive the bottom 20 of the bottle 12, the same stability to the container 12 will be attained when the stand 18 is employed for maintaining the bottle 12 in its inverted posture as when the bottle is maintained in its normal upright posture. In other words, the same support base is provided in both support postures.

It will further be appreciated that by dimensioning the cup-like stand 18 such that the end 26 of the nozzle 16 extends therebeyond when the nozzle 16 is opened, accurate dispensing of the contents of the bottle 12 may be attained. Accordingly, any obtrusiveness of the stand 18 is minimized.

Figure 4:
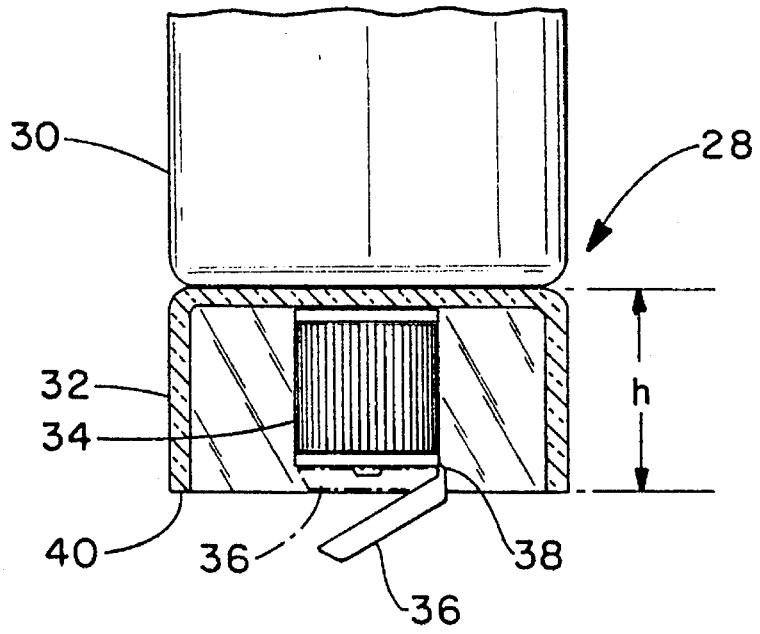
FIG. 4 is a front elevational view in partial cross section wherein a container is maintained in an inverted position by the stand of the invention, the container having a snap cap.

With reference now to FIG. 4, it can be seen that another embodiment of the invention is designated generally by the numeral 28. Here, a tubular container 20 is provided with a cup-shaped stand 32, with the cap 34 of the container 30 being received within the cup of the stand 32. The cap 34 is, in this instance, a snap cap in which a lid 16 is connected to the cap 34 by means of a hinge 38. Again, the depth of the stand 32 is configured such that the bottom edge or support surface 40 thereof defines a plane which is not broken by the lid 36 when in a closed position, but which is broken when the lid 36 is opened. Accordingly, inadvertent storage of the container 13 in an inverted posture with the lid 36 open is precluded.

It will, of course, be appreciated that the stand 32 may be provided as an integral portion of the container 30 or as an integral portion of the cap 34. The concept of the invention is intended to cover stands 18, 32 which are separate and distinct from their associated caps and bottles, or which are integral portions of either. Additionally, the concept of the invention extends to conainers with various types of caps and lids, only a couple of which have been specifically shown and described. For example, the stand of the invention may be employed with containers having push-pull caps, threaded caps, slide caps, and the like.

Figure 5:
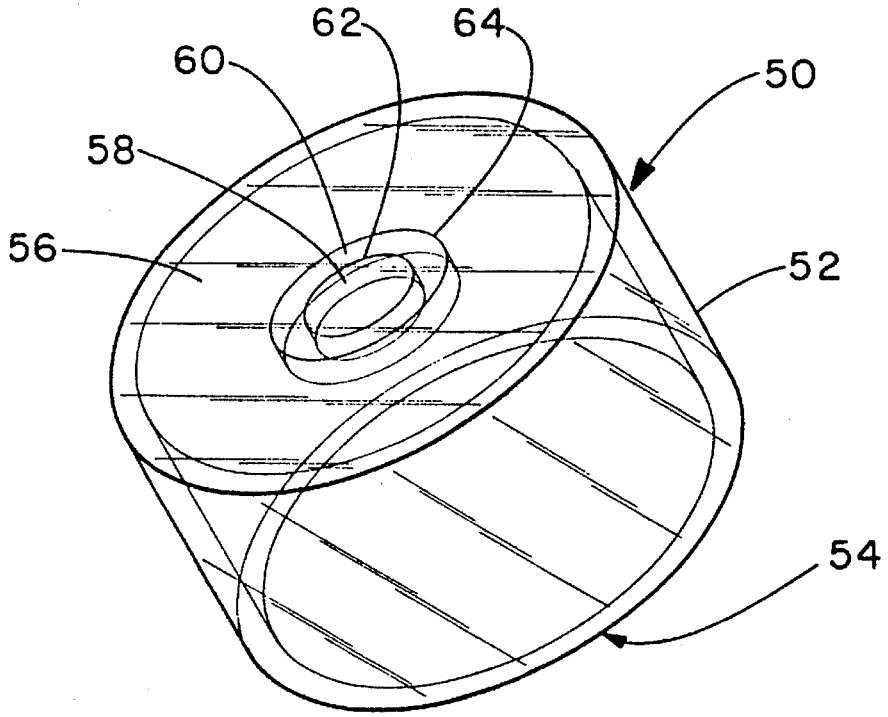
FIG. 5 is a perspective view of a container stand according to the invention having an adaptable feature to accommodate various containers.

With reference now to FIG. 5, yet another embodiment of the stand of the invention can be seen as designated by the numeral 50. The stand 50 employs a cup-shaped or tubular member 52 having a substantially open end 54 and an opposite and substantially closed end 56. The dosed end 56 is provided with an inner disc 58 and an outer disc 60, the same preferably being concentric and defined by scored or perforated circumferential lines 62, 64. With the circumferential boundaries of the respective discs 58, 60 being scored, perforated, or otherwise weakened, selected diameter openings or apertures may be introduced into the closed end 56 of the stand 50 to accommodate containers having threaded bosses, mouths, or the like of various sizes. Accordingly, the stand 50 may be sold or distributed as an item separate and distinct from the bottle or container with which it is to be associated. Of course, the number of concentric discs 58, 60 may vary to accommodate a wider or narrower range of containers.

Thus it can be seen that the objects of the invention have been satisfied by the structure presented above. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be made to the following claims.

What is claimed is:

1. A device for receiving, storing and dispensing viscous material, comprising:

a container;

a cap at a first end of said container, said cap being selectively opened and closed to respectively accommodate dispensing and storage of contents of said container; and a stand engaging said container at said first end thereof and supporting said container in an inverted posture with said first end at a lowermost position when said cap is closed, said inverted posture allowing said contents of said container to move to said first end, said stand defining a cup encircling and receiving said cap therewithin, said cup being open at one end and substantially closed at an opposite end, said substantially closed end being annular, having an aperture for receiving a portion of said first end of said container, said portion of said first end of said container comprising a threaded boss, threadedly receiving said cap, said stand having a lower support surface defining a plane such that said cap does not break said plane when said cap is closed and said container is in said inverted posture and said cap extends below said support surface when said cap is opened and said container is in said inverted posture.

2. The device according to claim 1, wherein said stand is integral with said cap.

3. The device according to claim 1, wherein said stand is separate and distinct from said cap.

4. A stand for receiving and mounting a container having a dispensing opening therein in an inverted position with the dispensing opening at a bottom of the container and closed by a cap, comprising:

a generally tubular member having a first open end and a second substantially closed end, said second end having an aperture for receiving an end of the container having the dispensing opening therein, said tubular member being adapted to be secured to the container by the caps and wherein said second end has a plurality of concentric rings defining selectable apertures of various sizes.

5. The stand according to claim 4, wherein said concentric rings are weakened for ease of removal from said second end.

6. The stand according to claim 5, wherein said concentric rings are weakened by scoring.

7. A device for receiving, storing and dispensing viscous material, comprising:

a container;

a cap at a first end of said container, said cap being selectively opened and closed to respectively accommodate dispensing and storage of contents of said container;

a stand engaging said container at said first end thereof and supporting said container in an inverted posture with said first end at a lowermost position when said cap is closed, said inverted posture allowing said contents of said container to move to said first end, said stand defining a cup encircling and receiving said cap therewithin, said cup being open at one end and substantially closed at an opposite end; and wherein said substantially closed end has a series of concentric discs in a portion thereof, said concentric discs adapted to be removed from said closed end to define an aperture.

8. The device according to claim 7, wherein said concentric discs are weakened within said closed end to facilitate removal therefrom to define said aperture.

9. A device for receiving, storing and dispensing viscous material, comprising:

a container;

a cap at a first end of said container, said cap being selectively opened and closed to respectively accommodate dispensing and storage of contents of said container; and a stand engaging said container at said first end thereof and supporting said container in an inverted posture with said first end at a lowermost position when said cap is closed, said inverted posture allowing said contents of said container to move to said first end, said stand defining a cup encircling and receiving said cap therewithin, said cup being open at one end and substantially closed at an opposite end, said substantially closed end being annular, having an aperture for receiving a portion of said first end of said container, said portion of said first end of said container comprising a threaded boss, threadedly receiving said cap, and wherein said container has a second end opposite said first end, and wherein said stand comprises a sleeve adapted to receive said second end of said container.

10. The device according to claim 9, wherein said sleeve is adapted to nestingly receive said container.

11. The device according to claim 10, wherein said container is elongated.

* * * * *